United States Patent [19]

St-Jacques

[11] Patent Number: 4,577,751

[45] Date of Patent: Mar. 25, 1986

[54] RETAINER FOR SOAP DISH

[76] Inventor: Jean St-Jacques, R.R. #2 Cregheur Rd., Luskville, Quebec, Canada, J0X 2G0

[21] Appl. No.: 643,986

[22] Filed: Aug. 24, 1984

[30] Foreign Application Priority Data

Apr. 19, 1984 [CA] Canada ..... 452386

[51] Int. Cl.[4] ..... A47K 5/00

[52] U.S. Cl. ..... 206/77.1; 248/310; 312/242; 211/90; 108/27; 4/628

[58] Field of Search ..... 206/77.1; 220/18; 248/310, 300, 205.3; 108/27; 312/242; 211/90; D6/536-540; 4/628

[56] References Cited

U.S. PATENT DOCUMENTS

| | | | |
|---|---|---|---|
| D. 97,514 | 11/1935 | Vail | D6/533 |
| 1,720,876 | 7/1929 | Anderson | 248/310 |
| 2,547,883 | 4/1951 | Olson | 224/42.42 R |
| 3,212,755 | 10/1965 | Liss et al. | 108/27 |
| 4,277,042 | 7/1981 | Ash, Sr. | 248/205.3 |
| 4,300,248 | 11/1981 | Dworkin | 312/242 |

*Primary Examiner*—William T. Dixson, Jr.
*Assistant Examiner*—Brenda J. Ehrhardt
*Attorney, Agent, or Firm*—Jones, Tullar & Cooper

[57] ABSTRACT

The specification describes a device which may be attached to a soap dish or tray of the type which is installed adjacent bath tubs or in shower stalls. The device when installed prevents bars of soap from sliding off the tray or dish while permitting the normal drainage of water.

15 Claims, 6 Drawing Figures

RETAINER FOR SOAP DISH

BACKGROUND OF THE INVENTION

This invention relates to soap trays and more particularly to a device which may be fitted to a soap tray to prevent bars of soap from slipping therefrom.

Soap trays and soap trays with wash cloth support bars are frequently installed on a wall adjacent to a bath tub. Similar fixtures are also common in built-in or molded shower cabinets. In either case the soap receiving surface of the tray slopes downwardly from back to front in order that water arriving thereon will drain off.

This inclined surface leads to the annoying result that bars of soap placed thereon fall to the tub or shower floor, particularly when the soap is wet.

The purpose of the present invention is to provide a soap stop which is adapted to be attached to such a soap tray or dish in order to prevent a bar of soap from sliding off the tray while permitting water to drain off.

SUMMARY OF THE INVENTION

Therefore, in accordance with the present invention there is provided a soap stop for use with a soap tray of the type which is attached to a vertical surface and has an inclined soap receiving surface, the soap stop comprising a stop arm adapted to be disposed in front of the soap receiving surface so as to retain a bar of soap thereon and a retaining means adapted to contact the soap tray for attachment thereto.

DESCRIPTION OF THE DRAWINGS

A preferred embodiment of the invention will now be described with reference to the appended drawings wherein.

DESCRIPTION DESCRIPTION

Figure 1:
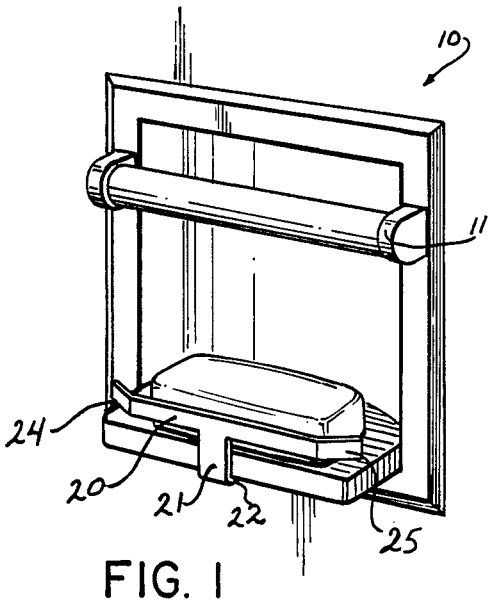
FIG. 1 is a perspective view of a soap stop attached to a soap tray.
Figure 3:
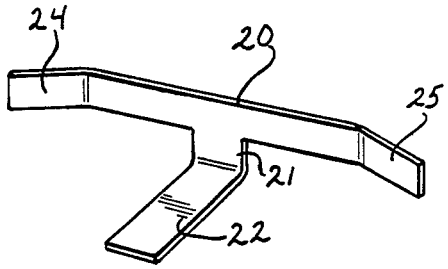
FIG. 3 illustrates the soap stop removed from the tray.
Figure 2:
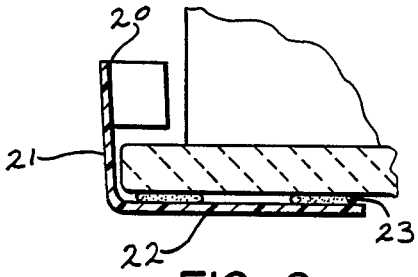
FIG. 2 is a cross-sectional view of the combination of FIG. 1.

A typical soap tray combination is shown generally by reference numeral 10 in FIG. 1. The combination includes a wash cloth bar 11 and a soap receiving surface 12. The soap receiving surface 12 is sufficiently recessed to hold a bath-size bar of soap and as a result the combination projects outwardly from the surface of the wall when installed thereon. Although the soap tray of FIG. 1 will be recognized as being the well known metal device it is to be understood that the soap tray is equally well suited for ceramic trays as well as trays of molded plastic construction.

The soap receiving surface is inclined so as to permit water collecting thereon to drain into the tub or shower stall.

The soap stop according to the invention comprises a stop member 20 which when installed is disposed parallel to the soap receiving surface 12 of the soap tray 10 but separated therefrom sufficiently to permit water to drain past. A retaining arm 21 projects downwardly from the stop member to the bottom edge of the soap tray. The arm 21 has a second portion 22 which projects rearwardly along and in contact with the under surface of the soap tray.

Figure 4:
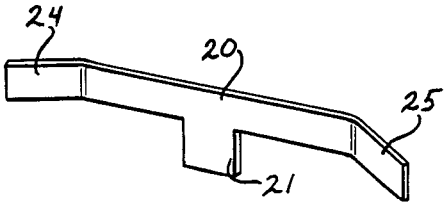
FIGS. 4–6 illustrates alternate embodiments of the present invention.
Figure 5:
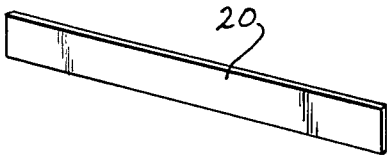

Although in the embodiment illustrated in FIG. 1 the attachment arm is secured to the underside of the soap receiving surface it is to be understood that other configurations wherein the attachment is directly to the front face or inside of the soap tray are contemplated. For example, in the embodiment of FIG. 4 arm 21 may be attached to the lower front surface of the tray or wall or the sides of the member 20 may be secured to the sides of the soap tray. FIG. 5 illustrates an embodiment suitable for the second example. These examples would apply in the case where the front face of the soap tray is flush with the surrounding surface as in a molded shower cabinet.

A suitable attachment means such as double sided tape 23 is provided on the portion 22 so as to retain the soap stop in a fixed position. It is understood, of course, that a tape or adhesive of the type which is not affected by water is used.

Figure 6:
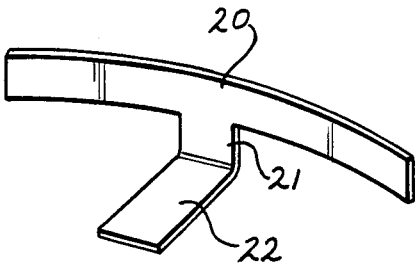

In the preferred embodiment the upper arm 20 has curved or bent portions 24 and 25. Other shapes such as that shown in FIG. 6, a continous curve, or a generally flat configuration as seen in FIG. 5 are contemplated by the invention.

A plastic material is best suited for the soap stop although other materials such as certain metals, rubber, vinyl or a combination thereof may be acceptable.

If a plastic material such a polyethylene or polyurethene is used. the desired shape may be produced by cutting the material from a sheet and subsequently bending it to shape or by injection molding in the desired structure.

A range of colors which complement the colors of standard bath room fixtures is available.

In the preferred embodiment a strip of adhesive is applied to the upper surface of the arm portion 22. This adhesive has a removable coating which is stripped from the adhesive just prior to the installation on the underside of the soap tray. If other configurations are used the adhesive strip is applied at suitable attaching locations.

It is also contemplated that the soap stop according to the present invention is of a type which fits entirely within the tray or dish and has a bar or suitable teeth which retain the soap on the tray.

Although the invention has been described by way of illustration and example for purposes of clarity and understanding it will be obvious that certain charges and modification may be practiced within the scope of the appended claims.

The embodiments of the invention in which an exclusive property or privilege is claimed are defined as follows:

1. A soap stop attachment for use with a soap tray or dish of the type which is attached to a vertical surface and has an inclined soap-receiving surface, said soap stop comprising:

a horizontally disposed, elongated stop arm adapted to be disposed in a soap-retaining position in front of and above the edge of said soap-receiving surface, said stop arm extending substantially completely across the width of said soap-receiving surface so as to retain a bar of soap thereon; and a retaining means connected to said stop arm and adapted to contact said soap tray for attachment thereto to secure said stop arm in said soap-receiving position.

2. The soap stop of claim 1 wherein said retaining means is provided with an adhesive material for attachment of said stop to said soap tray.

3. The soap stop of claim 2 wherein said adhesive material is in tape form having a removable covering thereon.

4. The soap stop of claim 2 wherein said adhesive material is glue.

5. The soap stop of claim 1, wherein said retaining means includes a vertically disposed elongated retainer arm connected at its upper end to the center of said stop arm and a horizontal connector arm disposed at right angles to said stop arm and said retainer arm and connected to the lower end of said retainer arm, said connector being adapted to be attached to an underside of said soap-receiving surface.

6. The soap stop of claim 1 manufactured from a plastics material.

7. The soap stop of claim 6 wherein said plastic material is cut in a first step and bent to shape in a second step.

8. The soap stop of claim 6 produced by injection molding.

9. The soap stop of claim 1 wherein said stop arm extending horizontally across the front of the soap receiving surface.

10. The soap stop of claim 9 wherein said retaining means includes adhesive means at either ends of said soap stop arm for attachment to the sides of the soap tray.

11. The soap stop of claim 1 wherein said retaining means includes an arm connected to said stop arm which is adapted to be attached to a lower front face of said soap tray.

12. The soap stop of claim 1 manufactured from metal.

13. The soap stop of claim 1 manufactured from rubber.

14. The soap stop of claim 5, wherein said retaining means further includes adhesive material for attaching said retainer arm to an underside of said soap-receiving surface.

15. The soap stop of claim 14, wherein said adhesive material is in tape form having a removable cover thereon.

* * * * *